US006082562A

United States Patent [19]

Riikonen

[11] Patent Number: 6,082,562

[45] Date of Patent: Jul. 4, 2000

[54] BRIDGE CRANE

[75] Inventor: Ilkka Riikonen, Hyvinkää, Finland

[73] Assignee: KCI Konecranes International PLC, Hyvinkaa, Finland

[21] Appl. No.: 09/318,768

[22] Filed: May 26, 1999

[30] Foreign Application Priority Data

May 28, 1998 [FI] Finland ..... 981191

[51] Int. Cl.[7] ..... B66C 17/00

[52] U.S. Cl. ..... 212/312; 105/171; 105/163.2

[58] Field of Search ..... 212/312, 324, 212/325, 226; 105/171, 163.2

[56] References Cited

U.S. PATENT DOCUMENTS

| | | | |
|---|---|---|---|
| 2,294,999 | 9/1942 | Kramer et al. | 105/171 |
| 3,246,775 | 4/1966 | Connelly et al. | 105/163.2 |
| 3,604,567 | 9/1971 | Tanaka | 212/312 |
| 3,606,029 | 9/1971 | Verlinde | 212/312 |
| 4,289,076 | 9/1981 | Miller | 212/312 |
| 4,955,293 | 9/1990 | Kramer et al. | 105/171 |
| 5,788,096 | 8/1998 | Wilcox | 212/324 |

FOREIGN PATENT DOCUMENTS

| | | | |
|---|---|---|---|
| 2004441 | 11/1969 | France | 212/324 |
| 2351904 | 12/1977 | France | 212/312 |
| 1125131 | 3/1962 | Germany | 212/312 |

*Primary Examiner*—Thomas J. Brahan
*Attorney, Agent, or Firm*—Birch, Stewart, Kolasch & Birch, LLP

[57] ABSTRACT

A bridge crane includes at least one main girder (1), a trolley moving on the main girder or at least one hoist gear fixed to the main girder, end carriages (4) arranged at the ends of the main girder to support the main girder, wheels arranged to the end carriages intended to move along substantially parallel rails (7) substantially parallel to the end carriages and on the other hand substantially transverse in relation to the main girder and thus to support the entire crane on the rails, while slides (10 to 17) have been arranged between one end carriage (4) and the corresponding end (9) of the main girder (1) allowing a longitudinal movement of the end carriage (4) in relation to the main girder (1) and a rotation of the end carriage and main girder in relation to each other.

12 Claims, 3 Drawing Sheets

BRIDGE CRANE

BACKGROUND OF THE INVENTION

The invention relates to a bridge crane comprising at least one main girder, a trolley moving on the main girder or at least one hoist gear fixed to the main girder, end carriages arranged at the ends of the main girder to support the main girder, wheels arranged to the end carriages intended to move along substantially parallel rails substantially parallel to the end carriages and on the other hand substantially transverse in relation to the main girder and thus to support the entire crane on said rails, while slide means have been arranged between one end carriage and the corresponding end of the main girder allowing a longitudinal movement of said end carriage in relation to the main girder and a rotation of said end carriage and main girder in relation to each other, and stop means have been arranged between the main girder and the end carriage to restrict the movement between the end carriage and main girder.

It is very common for bridge cranes to have the following problematic conditions and situations: either one or both rails may be bent and thus at the limits of the allowed tolerances or in excess thereof. The rail track may be indeterminate or variable, especially on tracks located outdoors or on tracks arranged in halls with a flexible framework. The rail track of a crane may change due to changes in temperature, especially in cranes located outdoors. The crane may also have to be built in conditions where the direction of all rail wheels cannot be guaranteed to be within tolerances.

When using current bridge cranes, the movement of the crane may be difficult due to the above-mentioned reasons while the wear of the wheels and rails is heavy. To eliminate problems caused by the rails, the requirements for accuracy of manufacture of a crane have to be kept high, which raises the costs considerably. In addition, specific problems are caused by the drive means of the crane and their different controls which affect the directness of crane movement in different situations. In such cases, deflected movement may cause extensive problems.

BRIEF DESCRIPTION OF THE INVENTION

It is an object of the present invention to improve the traditional bridge crane so that the above-mentioned problems are eliminated or substantially diminished. This object is achieved by a bridge crane of the invention, which is mainly characterized by slide means comprising a base plate attached to the top surface of the end carriage, a top plate attached to the bottom surface of the main girder, and slide means between the base plate and the top plate; and by stop means comprising pin means attached to the base plate and slot means attached to the top plate.

The invention is thus based on the idea of arranging one of the joints between the bridge crane's main girder and end carriage to be flexible or to slide so as to allow the main girder to move longitudinally and to rotate in relation to the end carriage so that when the crane moves along the rails, the variations in form and dimension caused by the reasons mentioned above can be compensated for. During a normal run, the second end carriage, which is joined to the main girder with a traditional fixed joint, alone guides the direction of the crane according to its rail.

The joint of the invention is intended for use in any bridge crane, in one-main girder and two main girder cranes as well as in cranes provided with torsion trolleys. The end carriage may, for instance, have 2, 4, 6, or 8 wheels. The joint is suitable for both new cranes and cranes to be modernised.

The end carriage of the bridge crane that has been provided with the joint of the invention, is self-directing. If the wheels of the end carriage are parallel, once the end carriage has settled in the direction of the track, it runs continuously in this direction and hardly ever touches the rail with its flanges. This means that the flanges of the wheels and the sides of the rails wear very little. As the wear of the rail bearing surface is mainly caused by the "grinding" of a deflected wheel, this, too, will be substantially diminished, because the wheels run straight, the rotation axis of the wheel being in perpendicular alignment with the running direction of the wheel almost all the time.

If the rail is so bent that at places it touches the flange of the wheel, the end carriage turns and slides sideways until it is again aligned in the main direction of the track.

As the effective span tolerances are now managed by a slide margin, possible variation of the rail track need not be taken into consideration in the slot clearance of the rail wheels. The slot clearance of the wheel can be chosen according to the estimated "twisting margin" required in a channel formed by consecutive wheels so that the flange contact need not turn the crane according to every rail bend. Where a slot clearance of 20 to 30 mm was earlier required, now a less than a 10-mm clearance can be used. With extremely good and straight tracks, even a 5-mm slot clearance can be recommended, as sometimes used with guide rollers.

The advantage of a shorter slot clearance is that even the guiding end cannot turn into a difficult toe-in. The deflection forces are thus substantially diminished. This means that the wheel flanges of the guiding end wear less, as do the bearing surfaces and the rail. The use of guide rollers is unnecessary. This is a great benefit in places where guide rollers would not fit in well.

Smaller friction forces can also be taken into consideration in the specification of motor power. Less power is used, which improves the cooling of the motor.

In a preferred embodiment of the invention the pin means comprise two upward extending pins attached to the base plate and the slot means comprise an elongated opening in the top plate, in which a slide piece has been fitted with a section extending inside the opening and having a length shorter than the opening length by the allowed longitudinal main girder movement and having a width corresponding substantially to the width of the opening yet allowing a reciprocal longitudinal movement, shoulders extending to the top edges of the opening, a first round hole substantially equal in diameter to the diameter of the first pin, through which the first pin has been directed, and a second elongated, for instance, oblong, hole through which the second pin has been directed so that it can move sideways in the hole while the pins are locked in the holes with locking nuts attached to the ends of the pins.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following the invention will be described in greater detail with reference to the attached drawings which are given by way of illustration only, and thus are not limitative of the present invention, and, in which.

DETAILED DESCRIPTION OF THE INVENTION

Figure 1:
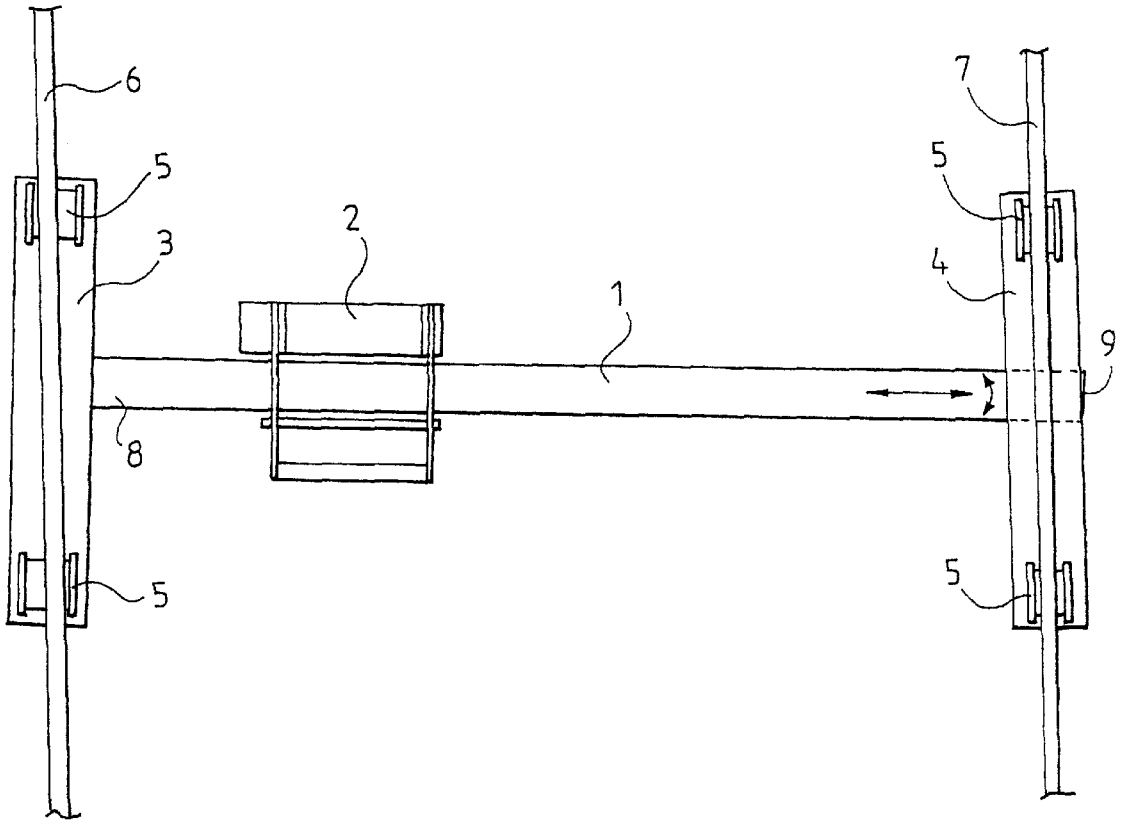
FIG. 1 shows a bridge crane provided with one main girder from below the rails along which the crane moves.

FIG. 1 shows a bridge crane of the invention comprising a main girder 1, a trolley 2 moving on the main girder 1 or at least one hoist gear fixed to the main girder, end carriages 3 and 4 arranged at the ends of the main girder 1 to support the main girder 1, and wheels 5 arranged to the end carriages and intended to move along rails 6 and 7 substantially parallel to the end carriages 3 and 4 and on the other hand substantially transverse in relation to the main girder 1 and thus to support the entire crane on said rails 6 and 7.

It is essential to the bridge crane of the invention that elements have been arranged between one end carriage 4 and the corresponding end 9 of the main girder 1 to allow a restricted longitudinal movement of said end carriage 4 in relation to the main girder 1 and a restricted rotation of the end carriage 4 and the main girder 1 in relation to each other while the other end 8 of the main girder 1 is attached to the end carriage 3 with a traditional fixed joint guiding the crane.

Figure 2:
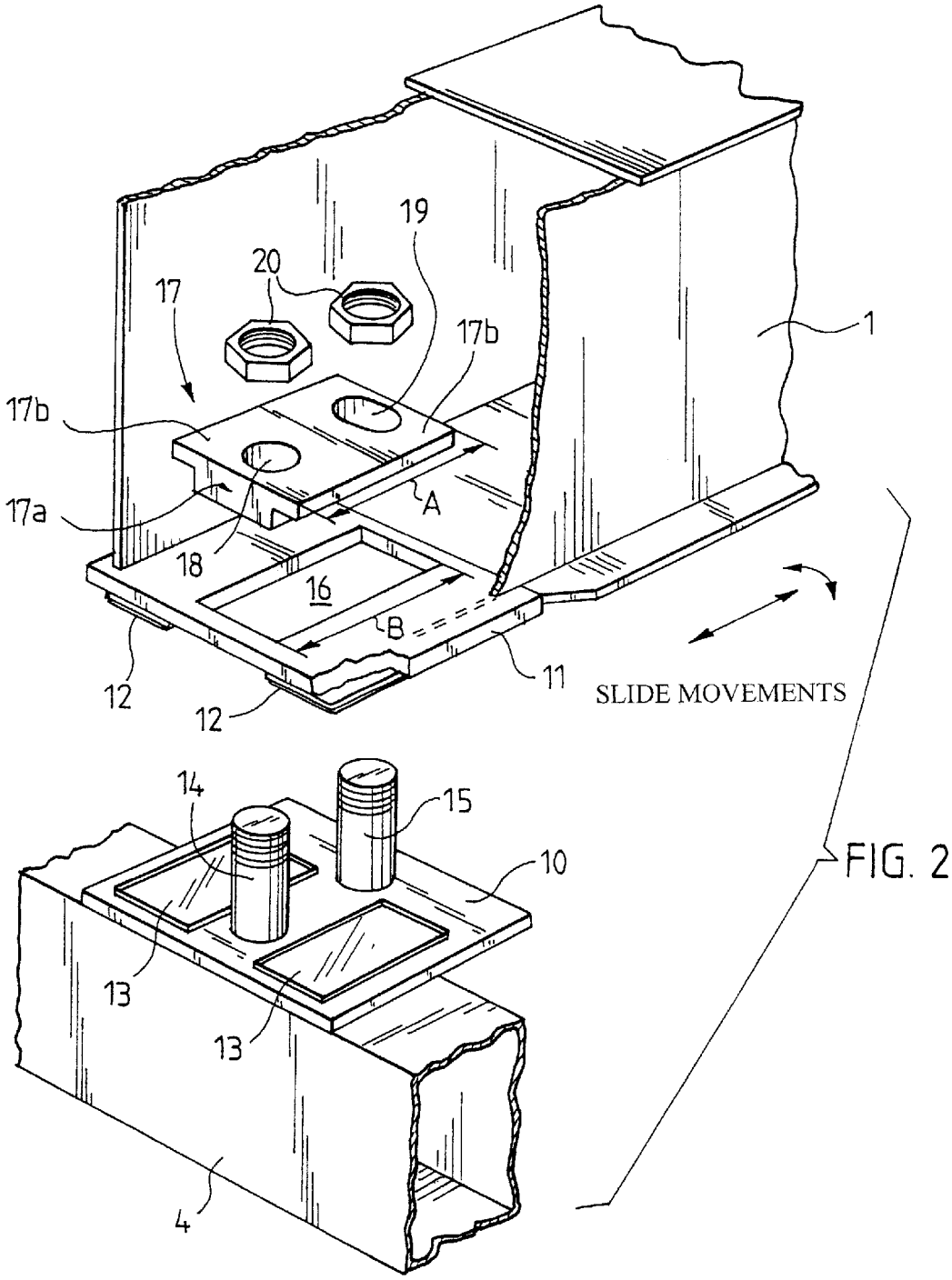
FIG. 2 shows a preferred joint of the invention in an exploded view.
Figure 3:
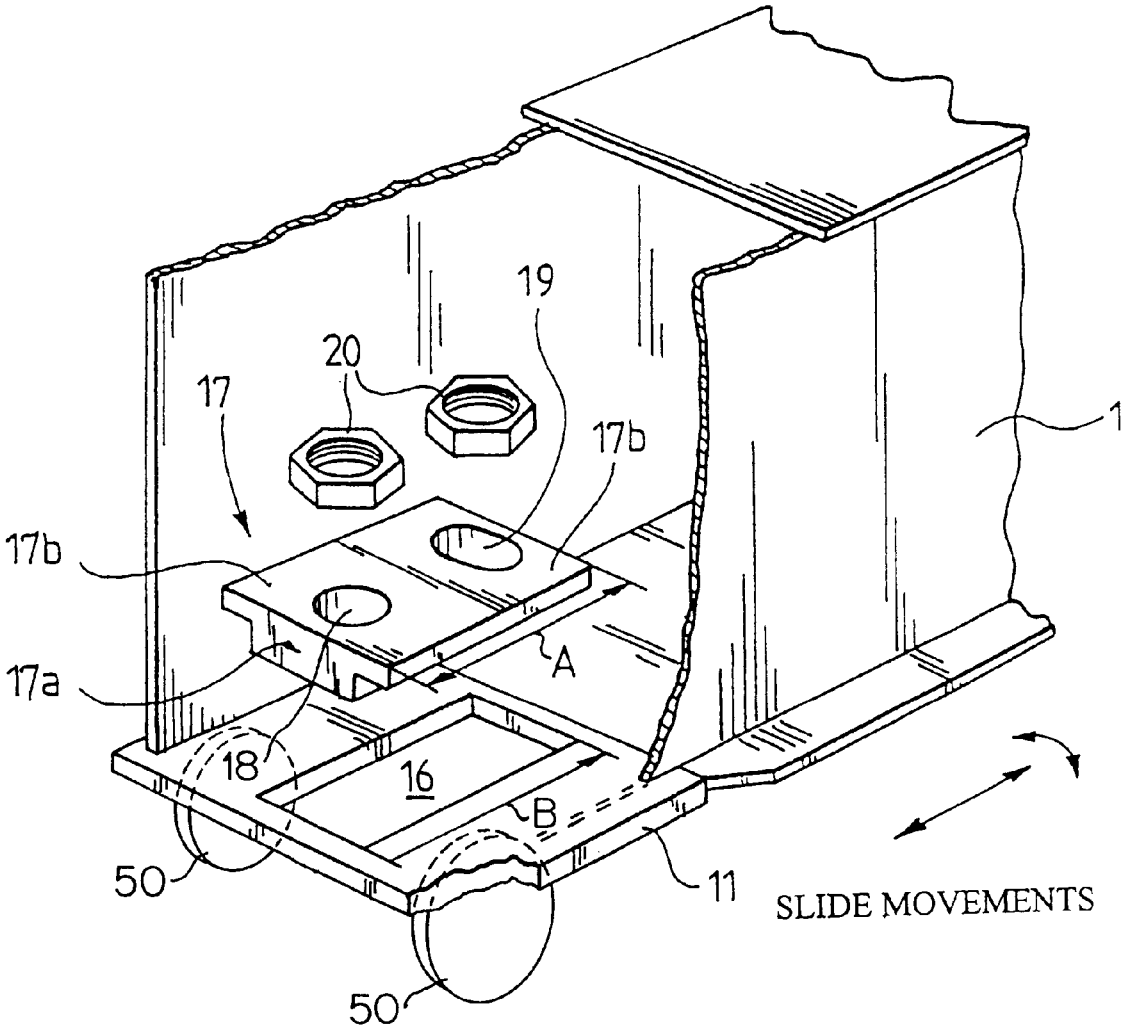
FIG. 3 shows a view similar to FIG. 2 except rollers instead of slide blocks are utilized.

The means allowing said movements comprise slide means fitted to the main girder 1 and the end carriage 4 as well as stop means fitted between the main girder 1 and the end carriage 4 to restrict the longitudinal movement of the main girder 1 to a certain length and the rotation between the end carriage 4 and the main girder 1 to a certain angle, and which means are described in the following with reference to FIG. 2.

The slide means comprise a base plate 10 attached to the top surface of the end carriage 4 and a top plate 11 attached to the bottom surface of the end 9 of the main girder 1 working together with the base plate 10.

To enable said sliding, slide blocks 12 have been attached to the top plate 11 and oil or grease-filled trays 13 have been arranged to the base plate 10, in which trays the slide blocks can move within the limits defined by the stop means described next. The trays 13 are, however, not essential to the operation of the slide system, as self-lubricating slide blocks also exist.

The stop means comprise two upward extending pins 14 and 15 attached to the base plate 10, an elongated opening 16 in the top plate 11, and a slide piece 17 fitted to the opening 16 with a section 17*a* extending inside the opening 16 having a length A shorter than the opening 16 length B by the allowed longitudinal main girder 1 movement and having a width corresponding substantially to the width of the opening 16 yet allowing a reciprocal longitudinal movement, shoulders 17*b* extending to the top edges of the opening 16, a first round hole 18 substantially equal in diameter to the diameter of the first pin 14, through which the first pin 14 has been directed, and a second oblong hole 19 through which the second pin 15 has been directed so that it can move sideways in the hole 19, while the pins 14 and 15 are locked in the holes 18 and 19 with locking nuts 20 attached to the ends of the pins. Sections 17*a* and 17*b* can also be separate pieces, in which case the oblong hole 19 is absolutely required only in the lower section 17*a*. The hole 19 could, in principle, also be a rectangle or a large circle, but this would not be as good and strong a structure as the one mentioned above. The slide blocks on the top plate 11 can also be replaced by rollers.

A typical slide margin in the direction of the main girder 1 in the above-mentioned joint is approximately 50 mm and the rotation approximately 0.1 rad.

The joint is intended to function so that in normal situations, the limiters of the sliding movements are not met. Thus no counter forces are created to the limiters; transverse movement or rotation is resisted only by friction force which has been minimized by an appropriate selection of material and continuous lubrication in a grease bath. The fact that the limiters are not met, is managed by other rigidity of the crane and an appropriate selection of the nominal rail track.

The limiters have also been arranged to prevent the joint from opening in any accident or emergency and the main girder 1 from falling off the end carriage 4. The limiters have been designed in such a way that the joint shall in extreme conditions endure the same horizontal forces and force couples directed to the bearing wheels 5 as the traditional fixed joints.

The present invention affects the design of the rails 6 and 7 in such a way that if only cranes provided with the joint of the invention are run on them, the sleeper of the rail (in this case, rail 7) under the slide joint can be designed for smaller horizontal forces corresponding to the friction forces of the slide joint. A smaller sleeper is enough. This is good to know for modernisations where crane loads are upgraded.

The above description of the invention is only intended to illustrate the invention. A person skilled in the art may implement its details in a variety of alternative ways within the scope of the attached claims. Consequently, the invention is also applicable to, for instance, a bridge crane comprising several main girders. In such a case, all flexible joints must naturally be located on the same side of the crane.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A bridge crane comprising:

at least one main girder;

at least one hoist gear fixed to the main girder;

end carriages arranged at ends of the main girder to support the girder;

wheels arranged on the end carriages, the end carriages being movable along rails adjacent to the end carriages, the rails being substantially parallel to the end carriages and being substantially transverse to the main girder whereby the crane is supported on the rails;

slide means arranged between one end of the carriage and the corresponding end of the main girder for allowing a longitudinal movement of the end carriage in relation to the main girder and allowing rotation of the end carriage and main girder in relation to each other, the slide means includes a base plate attached to the top surface of the end carriage, a top plate attached to the bottom surface of the main girder and a slide between the base plate and the top plate; and stop means arranged between the main girder and the end carriage with the slide means for restricting movement between the end carriage and the main girder, the stop means includes a pin attached to the base plate and a slot formed in the top plate.

2. The bridge crane as claimed in claim 1, further comprising a trolley movable on the main girder.

3. The bridge crane as claimed in claim 1, wherein the slide comprises slide surfaces arranged on the base plate and on the top plate.

4. The bridge crane as claimed in claim 3, wherein the slide surfaces comprise at least one slide block attached to the top plate and at least one oil tray arranged on the base plate, the at least one slide block being movable in the at least one oil tray.

5. The bridge crane as claimed in claim 4, wherein the at least one slide block includes a plurality of slide blocks and wherein the at least one oil tray includes a plurality of oil trays.

6. The bridge crane as claimed in claim 1, wherein the slide comprises roller elements.

7. The bridge crane as claimed in claim 1, wherein the pin includes a plurality of upwardly extending pins attached to the base plate, wherein the slot is an elongated opening in the top plate, and wherein the slide includes a slide piece, the slide piece being positionable in the elongated opening in the top piece, a length of the slide piece in the elongated opening being shorter than a length of the elongated opening to thereby permit longitudinal main girder movement, a width of the slide piece corresponding to a width of the elongated opening.

8. The bridge crane as claimed in claim 7, wherein the slide piece further has at least two holes, the first hole having a substantially same diameter as a diameter of one of the upwardly extending pins and the second hole being elongated whereby another of the upwardly extending pins is movably positioned therein, the another upwardly extending pin in the second hole being movable sideways.

9. The bridge crane as claimed in claim 8, wherein the first hole is generally round and the one upwardly extending pin having a substantially same diameter is positioned in the first hole.

10. The bridge crane as claimed in claim 8, wherein the second hole is oblong.

11. The bridge crane as claimed in claim 8, wherein the one upwardly extending pin having a substantially same diameter is positioned in the first hole and wherein the bridge crane further comprises locking nuts for holding the upwardly extending pins in the holes, the locking nuts being affixable on the ends of the pins.

12. The bridge crane as claimed in claim 1, wherein only one of the end carriages has the slide means and the stop means and wherein another of the end carriages is rigidly affixed to the main girder.

* * * * *

UNITED STATES PATENT AND TRADEMARK OFFICE

CERTIFICATE OF CORRECTION

PATENT NO. : 6,082,562

DATED : July 4, 2000

INVENTOR(S): Ilkka RIIKONEN

It is certified that error appears in the above-identified patent and that said Letters Patent are hereby corrected as shown below:

"[73] Assignee:", please change "Hyvinkaa, Finland" to --Hyvinkää, Finland --.

Signed and Sealed this

Fifteenth Day of May, 2001

*Attest:*

Nicholas P. Godici

NICHOLAS P. GODICI

*Attesting Officer*

*Acting Director of the United States Patent and Trademark Office*